US011205394B2

(12) United States Patent
Kang

(10) Patent No.: US 11,205,394 B2
(45) **Date of Patent: *Dec. 21, 2021**

(54) METHOD FOR DRIVING LIQUID CRYSTAL DISPLAY DEVICE

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (IL)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/040,438

(22) PCT Filed: Oct. 31, 2018

(86) PCT No.: PCT/CN2018/113041

§ 371 (c)(1),
(2) Date: Sep. 22, 2020

(87) PCT Pub. No.: WO2019/184338

PCT Pub. Date: Oct. 3, 2019

(65) Prior Publication Data

US 2021/0020127 A1 Jan. 21, 2021

(30) Foreign Application Priority Data

Mar. 30, 2018 (CN) ..... 201810292399.3

(51) Int. Cl.
*G09G 3/36* (2006.01)
*G09G 3/34* (2006.01)

(52) U.S. Cl.
CPC ..... *G09G 3/3607* (2013.01); *G09G 3/342* (2013.01); *G09G 3/3413* (2013.01);
(Continued)

(58) Field of Classification Search
CPC ..... G09G 3/3406–3426; G09G 3/36–3696; G09G 2320/028; G09G 2320/0626; G09G 2320/0646
See application file for complete search history.

(56) References Cited

U.S. PATENT DOCUMENTS 9,035,867 B2 5/2015 Yoshida
2006/0262078 A1* 11/2006 Inuzuka ..... G09G 3/3413 345/102

(Continued)

FOREIGN PATENT DOCUMENTS

CN 101308633 A 11/2008
CN 101739958 A 6/2010

(Continued)

OTHER PUBLICATIONS

International Search Report from International Application No. PCT/CN2018/113041 dated Feb. 12, 2019.

*Primary Examiner* — Gene W Lee
(74) *Attorney, Agent, or Firm* — Marcus S. Simon

(57) ABSTRACT

Disclosed are display device and a method for driving same: calculating a sub-pixel scale average value of each pixel in a pixel unit corresponding to original gray scale data to be displayed in a display region, and shutting off a light source corresponding to a sub-pixel color having the smallest average gray scale value in a backlight unit corresponding to each display region.

17 Claims, 4 Drawing Sheets

(52) U.S. Cl.
CPC ..... *G09G 3/3426* (2013.01); *G09G 2320/028* (2013.01); *G09G 2320/0242* (2013.01); *G09G 2320/0252* (2013.01); *G09G 2320/0626* (2013.01); *G09G 2320/0646* (2013.01)

(56) References Cited

U.S. PATENT DOCUMENTS

| | | | | |
|---|---|---|---|---|
| 2012/0147067 | A1* | 6/2012 | Hashimoto | G09G 3/3611 345/690 |
| 2017/0256192 | A1* | 9/2017 | Knepper | G09G 3/2092 |
| 2019/0251914 | A1* | 8/2019 | Chen | G09G 3/342 |

FOREIGN PATENT DOCUMENTS

| | | | | | |
|---|---|---|---|---|---|
| CN | 103390390 | A | | 11/2013 | |
| CN | 107657928 | A | | 2/2018 | |
| CN | 107799079 | A | * | 3/2018 | G09G 5/026 |
| CN | 107799079 | A | | 3/2018 | |
| CN | 107808648 | A | | 3/2018 | |
| CN | 108346407 | A | | 7/2018 | |
| KR | 20150081021 | A | | 7/2015 | |

* cited by examiner

METHOD FOR DRIVING LIQUID CRYSTAL DISPLAY DEVICE

CROSS REFERENCE TO RELATED APPLICATIONS

This application claims priority to Chinese Patent Application No. 201810292399.3, filed with the Chinese Patent Office on Mar. 30, 2018 and entitled "LIQUID CRYSTAL DISPLAY DEVICE AND DRIVING METHOD THEREFOR", which is incorporated herein by reference in its entirety.

TECHNICAL FIELD

This application relates to the field of liquid crystal display technologies, and in particular to a driving method for a liquid crystal display device.

BACKGROUND

Among the large viewing angle and frontal viewing angle color shift variations of various representative color systems of liquid crystal displays, the red, green and blue color systems have more serious large viewing angle color shift than other color systems. Furthermore, due to the rapid saturation enhancement of the viewing angle brightness ratio of the gray scale liquid crystal display, the lower the gray scale value is, the greater the difference between the frontal viewing angle brightness and the side viewing angle brightness is.

The current method for improving color shift is as follows: each sub-pixel is subdivided into a primary pixel and a secondary pixel, the primary pixel is driven by a higher driving voltage, the secondary pixel is driven by a lower drive voltage, and the primary pixel and the secondary pixel together display one sub-pixel. When the primary pixel and the secondary pixel are respectively driven by the higher driving voltage and the lower driving voltage, the relationship between the brightness in the front viewing angle and the corresponding gray scale can be maintained unchanged. The method is generally as follows: in the first half of the gray scale, the primary pixel is driven by the higher driving voltage for display, the secondary pixel does not display, the brightness of the entire sub-pixel is half of the brightness of the primary pixel; and in the latter half of the gray scale, the primary pixel is driven by the higher driving voltage for display, the secondary pixel is driven by the lower drive voltage for display, and the brightness of the entire sub-pixel is half of the sum of the brightness of the primary pixel and the brightness of the secondary pixel. After such synthesis, the color shift at a large viewing angle is improved.

However, the above method has the problem that it is necessary to double the metal routing and driving devices to drive the secondary pixel, so that the light-transmissive opening area is sacrificed, the transmittance of the panel is affected, and the cost is also higher.

SUMMARY

Based on this, it is necessary to provide a driving method for a liquid crystal display device that can improve the large viewing angle color shift while ensuring that the cost is not increased.

Further, a liquid crystal display device is further provided.

A driving method for a liquid crystal display device, wherein the liquid crystal display device comprises: a display module, the display module comprising a plurality of pixel units arranged in an array, the pixel unit comprising a red sub-pixel, a green sub-pixel and a blue sub-pixel; and the display module being divided into at least two mutually independent display areas; and a backlight module, provided with a plurality of backlight units, the backlight unit comprising a red light source, a green light source and a blue light source; the display area corresponding to at least one of the backlight units; and backlight units corresponding to different display areas being independent of each other; and the driving method comprises:

respectively calculating average gray scale values of the red sub-pixel, the green sub-pixel and the blue sub-pixel in gray scale values corresponding to original gray scale data to be displayed in each of the display areas, and determining the magnitudes of the average gray scale values corresponding to the red sub-pixel, the green sub-pixel and the blue sub-pixel in each of the display areas; and turning off a light source in the backlight unit corresponding to each of the display areas, the light source having a same color as a sub-pixel having the minimum average gray scale value in the display area.

According to the above driving method for a liquid crystal display device, average gray scale values of the red sub-pixel, the green sub-pixel and the blue sub-pixel in gray scale values corresponding to the original gray scale data to be displayed in each of the display areas are respectively calculated, and the magnitudes of the average gray scale values corresponding to the red sub-pixel, the green sub-pixel and the blue sub-pixel in each of the display areas are respectively determined. When a decomposed gray scale data group is controlled to be displayed according to the magnitude relationship of the average gray scale values of the display areas, most backlights of corresponding colors having the gray scale value of 0 are turned off. Through such setting, the brightness ratio of the dominant hue is increased, so that the color shift due to the fact that the large viewing angle dominant hue is affected by a low voltage sub-pixel is improved. Meanwhile, the main signal brightness presentation under a large viewing angle is increased. The brightness of the overall image display can be maintained unchanged by increasing the backlight brightness to twice the original brightness, and the speed of the overall image display can be maintained unchanged by increasing a driving frequency to twice an original driving frequency.

DETAILED DESCRIPTION OF THE EMBODIMENTS

To make the objectives, technical solutions, and advantages of this application clearer and more comprehensible, the following further describes this application in detail with reference to the accompanying drawings and embodiments.

It should be understood that the specific embodiments described herein are merely used to explain this application but are not intended to limit this application.

Figure 1:
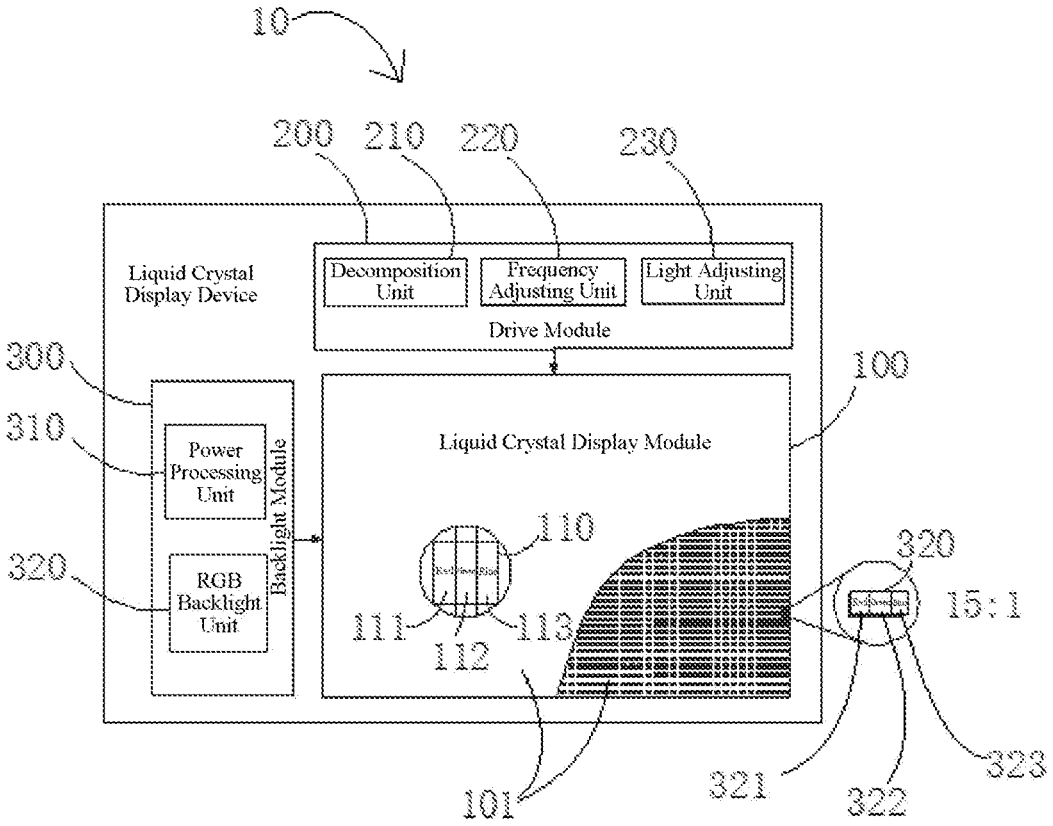
FIG. 1 is a schematic structural diagram of modules of a liquid crystal display device.

This application provides a driving method for a liquid crystal display device, as shown in FIG. 1, wherein the liquid crystal display device 10 includes: a display module 100, configured to display graphics and text information, the display module 100 including a plurality of pixel units 110 arranged in an array; the pixel unit 110 including a red sub-pixel 111, a green sub-pixel 112 and a blue sub-pixel 113; and the display module 100 being divided into at least two mutually independent display areas 101; and a backlight module 300, provided with a plurality of backlight units 320; the backlight unit 320 including a red light source 321, a green light source 322 and a blue light source 323; the display area 101 corresponding to at least one of the backlight units 320; and the backlight units 320 corresponding to different display areas 101 being independent of each other. The driving method includes:

respectively calculating average gray scale values of the red sub-pixel 111, the green sub-pixel 112 and the blue sub-pixel 113 in gray scale values corresponding to original gray scale data to be displayed in each of the display areas 101, and determining the magnitudes of the average gray scale values corresponding to the red sub-pixel 111, the green sub-pixel 112 and the blue sub-pixel 113 in each of the display areas 101.

In the time period of displaying a second gray scale data group, a light source in the backlight unit 320 corresponding to each of the display areas 101, which light source has a same color as a sub-pixel having the minimum average gray scale value in the display area 101, is turned off.

In one of the embodiments, the driving method further includes: determining a type of a color corresponding to an original gray scale data group to be displayed by each of the pixel units 110.

The original gray scale data group is divided into a first gray scale data group and a second gray scale data group according to a set grouping rule based on the type of the color corresponding to the original gray scale data group to be displayed by each of the pixel units 110, and the first gray scale data group and the second gray scale data group are respectively output and displayed in two consecutive time periods. The first gray scale data group is a ternary mixed color gray scale data group, a binary mixed color gray scale data group or a unitary color gray scale data group. The second gray scale data group is a binary mixed color gray scale data group or a unitary color gray scale data group.

The type of the color corresponding to the original gray scale data is determined according to the quantity of 0 gray scale data in the original gray scale data group to be displayed by each of the pixel units 110. When the original gray scale data group does not include the 0 gray scale data, it is determined that the color corresponding to the original gray scale data group is a ternary mixed color. When the original gray scale data group includes one piece of 0 gray scale data, it is determined that the color corresponding to the original gray scale data group is a binary mixed color. When the original gray scale data group includes two pieces of 0 gray scale data, it is determined that the color corresponding to the original gray scale data group is a unitary color.

Figure 2:
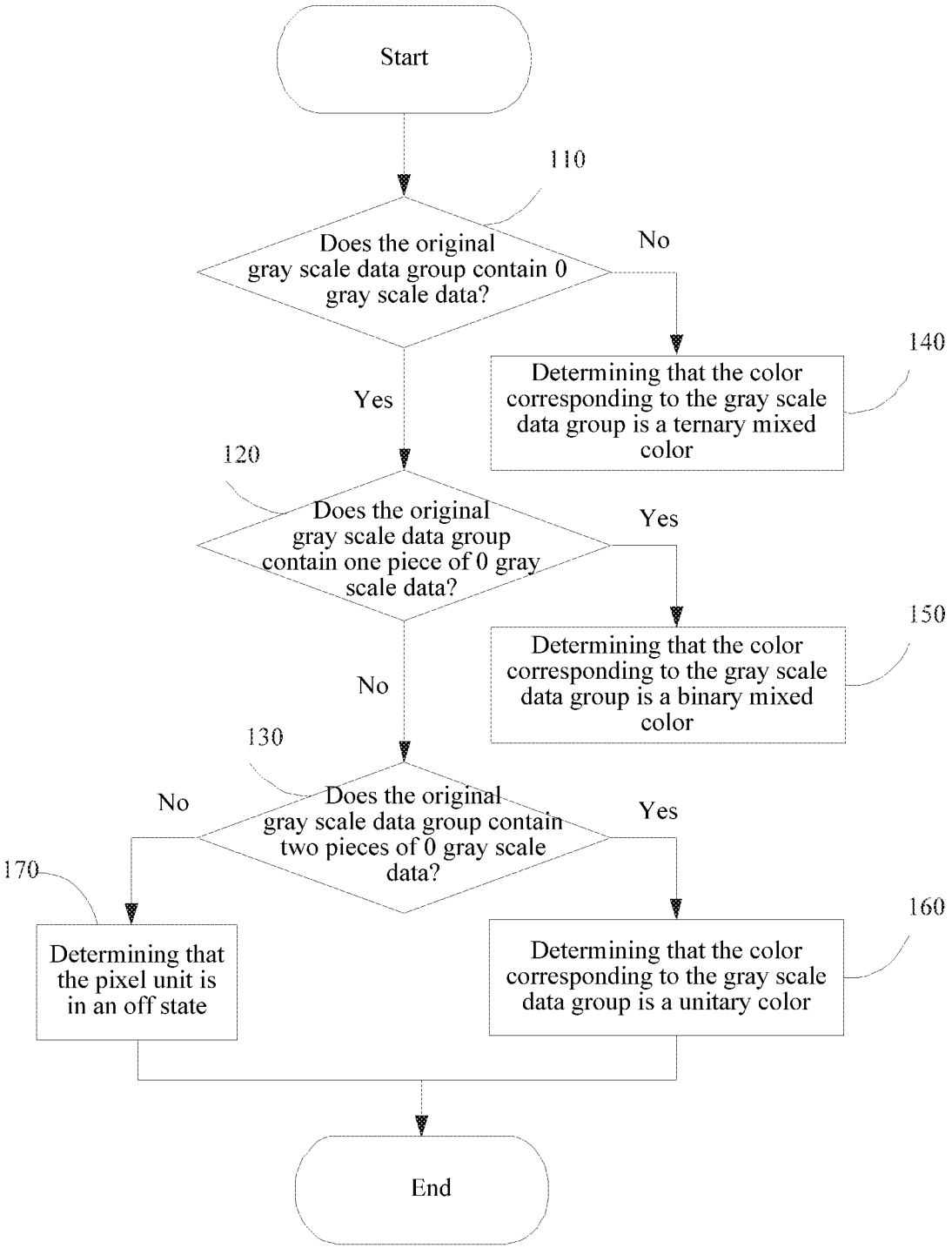
FIG. 2 is a flowchart of a driving method for determining a type of a display color of a pixel unit corresponding to an original gray scale data group.

Specifically, as shown in FIG. 2, an embodiment method of determining the type of the color corresponding to the original gray scale data group to be displayed by each of the pixel units 110 includes steps S110-S170.

S110: determining whether the original gray scale data group to be displayed by each of the pixel units 110 includes 0 gray scale data, and if yes, executing step S120; otherwise, executing step S140. A certain color being a ternary mixed color type indicates that the color includes colors of three components of red, green and blue. In the field of liquid crystal display, the gray scale values of the red sub-pixel, the green sub-pixel and the blue sub-pixel in the corresponding pixel unit 110 are not 0, that is, the corresponding original gray scale data group does not include 0 gray scale data, so it can be determined whether the original gray scale data group is a ternary mixed color gray scale data group by determining whether the original gray scale data group includes the 0 gray scale data.

S120: determining whether the original gray scale data group to be displayed by each of the pixel units 110 includes only one piece of 0 gray scale data, and if yes, executing step S150; otherwise, executing step S130. A certain color being a binary mixed color type indicates that the color includes any two colors of the three components of red, green and blue; and in the field of liquid crystal display, only one of the gray scale values of the red sub-pixel, the green sub-pixel and the blue sub-pixel in the corresponding pixel unit 110 is 0, and the other two are not 0, that is, the corresponding original gray scale data group includes only one piece of 0 gray scale data, so it can be determined whether the original gray scale data group is a binary mixed color gray scale data group by determining whether the original gray scale data group includes only one piece of 0 gray scale data.

S130: determining whether the original gray scale data group to be displayed by each of the pixel units 110 includes only two pieces of 0 gray scale data, and if yes, executing step S160; otherwise, executing step S170. A certain color being a unitary color type indicates that the color includes any one color of the three components of red, green and blue; and in the field of liquid crystal display, only two of the gray scale values of the red sub-pixel, the green sub-pixel and the blue sub-pixel in the corresponding pixel unit 110 are 0, and the other one is not 0, that is, the corresponding original gray scale data group includes only two pieces of 0 gray scale data, so it can be determined whether the original gray scale data group is a unitary color gray scale data group by determining whether the original gray scale data group includes only two pieces of 0 gray scale data.

S140: determining that the color displayed by the pixel unit 110 corresponding to the gray scale data group is a ternary mixed color.

S150: determining that the color displayed by the pixel unit 110 corresponding to the gray scale data group is a binary mixed color.

S160: determining that the color displayed by the pixel unit 110 corresponding to the gray scale data group is a unitary color.

S170: determining that the pixel unit 110 corresponding to the gray scale data group is in an off state. When the gray scale values of the sub-pixels of a certain pixel unit 110 are all 0, it indicates that the pixel unit 110 is not in charge of the display task. At this time, the voltage of each sub-pixel of the pixel unit 110 is 0, which is in an off state. Since light cannot pass through the liquid crystal, the pixel unit 110 appears black.

The grouping rule specifically includes:

Taking the minimum original gray scale data in the original gray scale data group corresponding to the ternary mixed color pixel unit 110 as common gray scale data of the red sub-pixel 111, the green sub-pixel 112 and the blue sub-pixel 113 in the pixel unit 110 to constitute the first gray scale data group.

Taking a difference data group obtained by substracting the first gray scale data group from the original gray scale data group corresponding to the ternary mixed color pixel unit 110 to serve as the second gray scale data group.

Taking the 0 gray scale data in the original gray scale data group corresponding to the binary mixed color pixel unit 110 as common gray scale data of the red sub-pixel 111, the green sub-pixel 112 and the blue sub-pixel 113 in the pixel unit 110 to constitute the first gray scale data group.

And taking the original gray scale data group corresponding to the binary mixed color pixel unit 110 as the second gray scale data group.

Alternatively, taking the minimum non-0 gray scale data in the original gray scale data group corresponding to the binary mixed color pixel unit 110 as common gray scale data of the sub-pixels corresponding to the two non-0 gray scale data in the pixel unit 110, together with the 0 gray scale data, to constitute the first gray scale data group. And taking a difference data group obtained by substracting the first gray scale data group from the original gray scale data group to serve as the second gray scale data group of the pixel unit 110.

Taking any 0 gray scale data in the original gray scale data group corresponding to the unitary color pixel unit 110 as common gray scale data of the red sub-pixel 111, the green sub-pixel 112 and the blue sub-pixel 113 in the pixel unit 110 to constitute the first gray scale data group. And taking the original gray scale data group as the second gray scale data group.

Alternatively, taking the gray scale data corresponding to half of the gray scale value corresponding to the non-0 gray scale data in the original gray scale data group corresponding to the unitary color pixel unit 110 (serving as gray scale data of the sub-pixel corresponding to the non-0 gray scale data in the pixel unit 110), together with the 0 gray scale date, to respectively constitute the first gray scale data group and the second gray scale data group.

Figure 3:
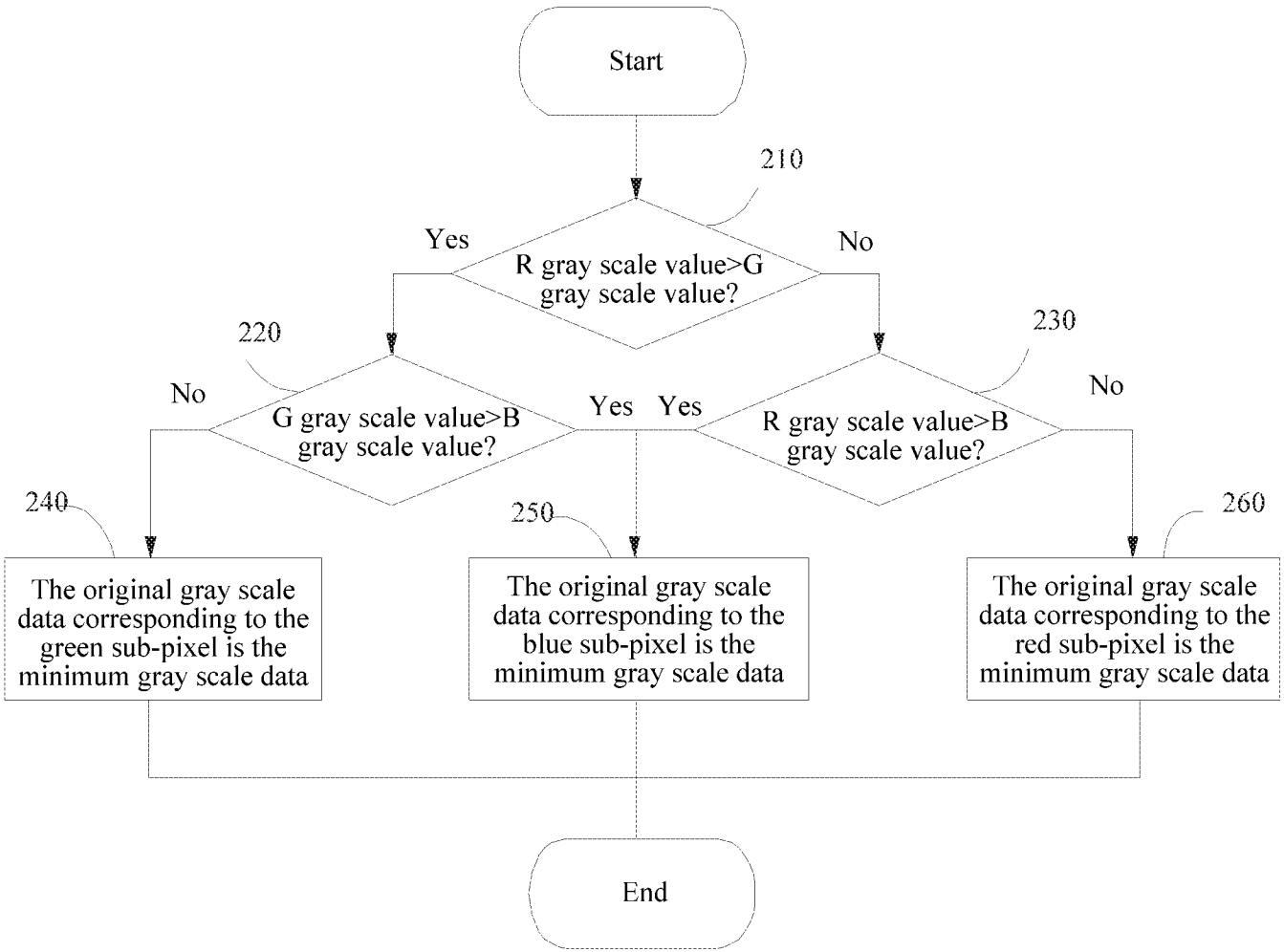
FIG. 3 is a flowchart of a driving method for determining the minimum gray scale data in a ternary mixed color gray scale data group.

An embodiment shown in FIG. 3 is a method for determining the minimum gray scale data in the ternary mixed color gray scale data group, which specifically includes steps S210-S260.

S210: determining whether a red gray scale value in an original gray scale value group corresponding to the original gray scale data group to be displayed by the ternary mixed color pixel unit 110 is greater than a green gray scale value therein, and if yes, executing step S220; otherwise, executing step S230. The step of firstly determining the magnitude relationship between the gray scale value corresponding to the red sub-pixel 111 and the gray scale value of the green sub-pixel 112 is merely an exemplary case listed for convenience of explanation. Actually, the gray scale values of any two colors of the red, green and blue sub-pixels may be adopted to perform determination firstly.

S220: determining whether the green gray scale value in the original gray scale value group is greater than a blue gray scale value therein, and if yes, executing step S250; otherwise, executing step S240. The step is to perform comparison and determination on the smaller gray scale value in step S210 and the gray scale value of another color, and output the corresponding determination result and an action signal.

S230: determining whether the red gray scale value in the original gray scale value group is greater than the blue gray scale value therein, and if yes, executing step S250; otherwise, executing step S260. The step is to perform comparison and determination on the smaller gray scale value in step S210 and the gray scale value of another color, and output the corresponding determination result and an action signal.

S240: determining that the gray scale data corresponding to the green sub-pixel in the original gray scale data group is the minimum original gray scale data.

S250: determining that the gray scale data corresponding to the blue sub-pixel in the original gray scale data group is the minimum original gray scale data.

S260: determining that the gray scale data corresponding to the red sub-pixel in the original gray scale data group is the minimum original gray scale data.

Figure 4:
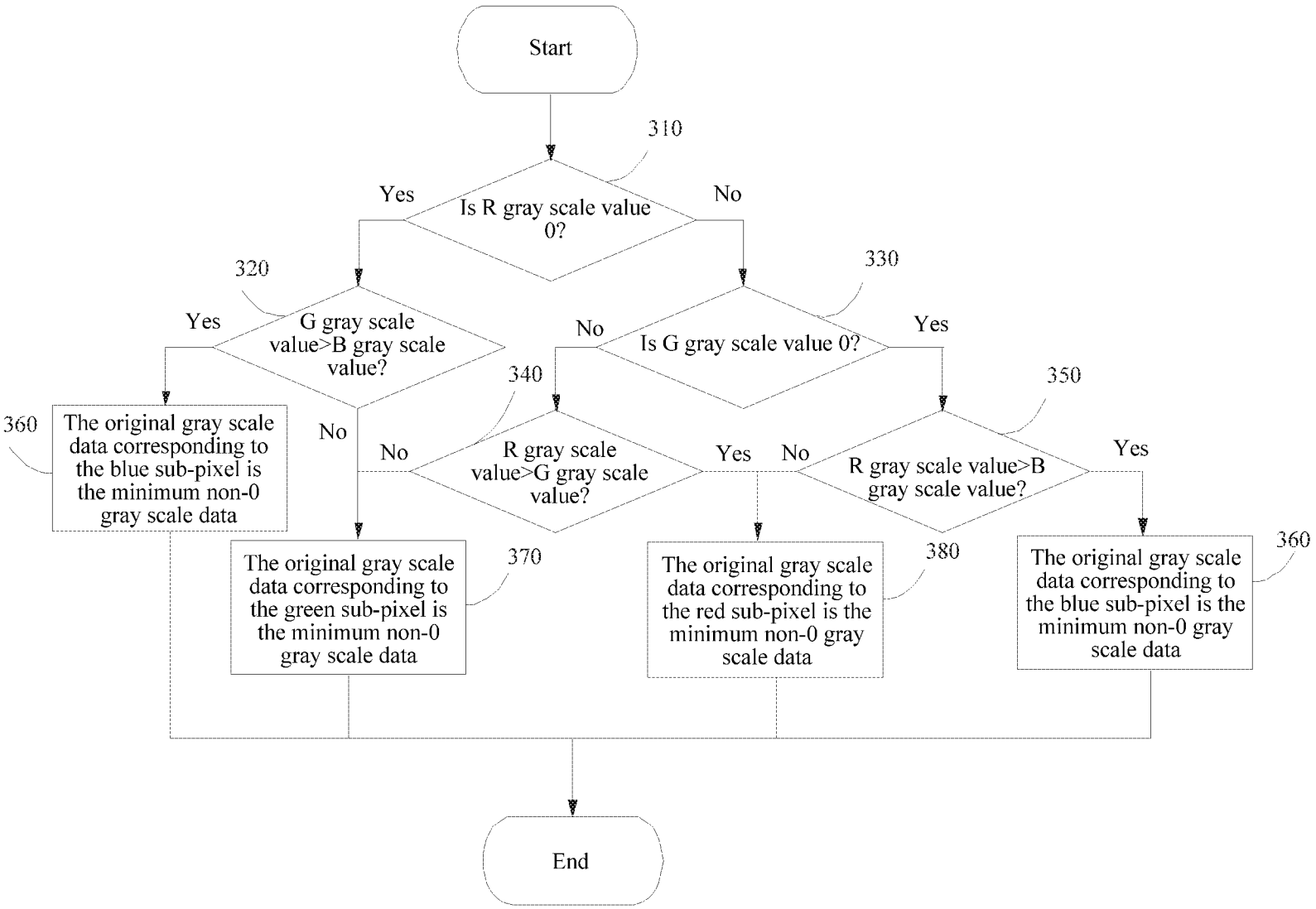
FIG. 4 is a flowchart of a driving method for determining minimum non-zero gray scale data in a binary mixed color gray scale data group.

An embodiment shown in FIG. 4 is a method for determining the minimum non-0 gray scale data in the binary mixed color gray scale data group, which specifically includes steps S310-S380.

S310: determining whether the red gray scale value in the original gray scale value group corresponding to the original gray scale data group to be displayed by the binary mixed color pixel unit 110 is 0, and if yes, executing step S320; otherwise, executing step S330.

A certain color being a binary mixed color type indicates that the color includes any two colors of three components of red, green and blue; and in the field of liquid crystal display, that means only one of the gray scale values of the red sub-pixel, the green sub-pixel and the blue sub-pixel in the corresponding pixel unit 110 is 0, and the other two are not 0, that is, the corresponding original gray scale data group includes only one piece of 0 gray scale data. The step of firstly determining whether the gray scale value corresponding to the red sub-pixel 111 is 0 is merely an exemplary case listed for convenience of explanation. Actually, the gray scale value of any one color of the red, green and blue sub-pixels may be adopted to perform determination firstly.

S320: determining whether the green gray scale value corresponding to the pixel unit 110 with the red sub-pixel gray scale value of 0 is greater than the blue gray scale value thereof, and if yes, executing step S360; otherwise, executing step S370. According to the step, it is determined that the color displayed by the pixel unit 110 is a mixed color of green and blue when determining that the gray scale value corresponding to the red sub-pixel 111 is 0, so that the minimum non-0 gray scale data in the original gray scale data group corresponding to the pixel unit 110 can be determined by determining the magnitude relationship between the green gray scale value and the blue gray scale value.

S330: determining whether the green gray scale value corresponding to the pixel unit 110 of which the red sub-pixel gray scale value is not 0 is 0, and if yes, executing step S350; otherwise, executing step S340. The step of determining whether the gray scale value corresponding to the green sub-pixel 112 is 0 after determining that the gray scale value corresponding to the red sub-pixel 111 is not 0 is merely an exemplary case listed for convenience of explanation. Actually, the gray scale value of the blue sub-pixel may be adopted to perform the determination.

S340: determining whether the red gray scale value corresponding to the pixel unit 110 with the blue sub-pixel gray scale value of 0 is greater than the green gray scale value thereof, and if yes, executing step S380; otherwise, executing step S370. According to the step, it is determined that the color displayed by the pixel unit 110 is a mixed color of green and red when determining that the gray scale value corresponding to the blue sub-pixel 113 is 0, so that the minimum non-0 gray scale data in the original gray scale data group corresponding to the pixel unit 110 can be determined by determining the magnitude relationship between the green gray scale value and the red gray scale value.

S350: determining whether the red gray scale value corresponding to the pixel unit 110 with the green sub-pixel gray scale value of 0 is greater than the blue gray scale value thereof, and if yes, executing step S360; otherwise, executing step S380. According to the step, it is determined that the color displayed by the pixel unit 110 is a mixed color of red and blue when determining that the gray scale value corresponding to the green sub-pixel 112 is 0, so that the minimum non-0 gray scale data in the original gray scale data group corresponding to the pixel unit 110 can be determined by determining the magnitude relationship between the red gray scale value and the blue gray scale value.

S360: determining that the original gray scale data corresponding to the blue sub-pixel in the original gray scale data group corresponding to the binary mixed color pixel unit 110 is the minimum non-0 gray scale data.

S370: determining that the original gray scale data corresponding to the green sub-pixel in the original gray scale data group corresponding to the binary mixed color pixel unit 110 is the minimum non-0 gray scale data.

S380: determining that the original gray scale data corresponding to the red sub-pixel in the original gray scale data group corresponding to the binary mixed color pixel unit 110 is the minimum non-0 gray scale data.

In the grouping rule, due to the rapid saturation enhancement of the viewing angle brightness ratio of the gray scale liquid crystal display, the lower the gray scale value is, the greater the difference between the frontal viewing angle brightness and the side viewing angle brightness is. Therefore, in order to highlight the dominant color and improve the color shift, the minimum gray scale data in the original gray scale data group is displayed in a separate group of gray scale data, and the color that does not include the minimum gray scale data can be displayed in other groups, thereby preventing the minimum gray scale color in the group from affecting the display of the dominant color due to the rapid saturation enhancement of the viewing angle brightness ratio of the gray scale liquid crystal display. In order to explain the grouping rule more clearly and directly, the following grouping description is performed on the gray scale value group. It should be noted that the grouping process is data grouping performed when processing the original gray scale data group. Here, the gray scale value group is used for illustration just for convenience and simplicity:

Assuming that the original gray scale data group corresponding to a certain pixel unit 110 is converted into an original gray scale value group (A, B, C), that is, the gray scale value corresponding to the red sub-pixel 111 is A, the gray scale value corresponding to the green sub-pixel 112 is B, and the gray scale value corresponding to the blue sub-pixel 113 is C. When A>B>C, it can be determined that the gray scale value corresponding to the blue sub-pixel 113 is the minimum gray scale value in the original gray scale values, that is, the minimum gray scale value, and the difference between the frontal viewing angle brightness and the side viewing angle brightness of the minimum gray scale value is the largest. In order to reduce the effect of the minimum gray scale value, the minimum gray scale value is used as the common gray scale value of the red sub-pixel 111, the green sub-pixel 112 and the blue sub-pixel 113 to constitute a first gray scale value group (C, C, C). A difference group obtained by substracting the minimum gray scale value respectively from the gray scale values corresponding to the red sub-pixel 111, the green sub-pixel 112 and the blue sub-pixel 113 in the original gray scale data is used as a second gray scale value group (A-C, B-C, 0).

Through such setting, the minimum gray scale value can be removed from the second gray scale value group, the effect of the minimum gray scale value on the color shift at a large viewing angle when the second gray scale value group is displayed can be eliminated, and the ratio of the sum of the gray scale values of the dominant colors after decomposition to the lower gray scale value is increased, thereby improving the color shift at a side viewing angle, and increasing the brightness of the dominant colors.

In the above content, the gray scale value data group and the gray scale value group both use the pixel unit 110 as the minimum unit, and are respectively data groups including gray scale data or gray scale values respectively corresponding to the red sub-pixel 111, the green sub-pixel 112 and the blue sub-pixel 113. The original gray scale data group refers to an original gray scale value data group input by the display device, including red, green and blue gray scale data. The original gray scale value group refers to a gray scale value group directly converted from the original gray scale data group, including red, green and blue gray scale data.

In the above grouping rule, the original gray scale data groups corresponding to the binary mixed color and the unitary color are each decomposed into three gray scale data groups, so as to keep the synchronization with the execution control manner of the ternary mixed color gray scale data group and facilitate driving and control.

Further, the liquid crystal display device 10 further includes a drive module 200. The drive module 200 is configured to receive, process and output driving data. The driving method further includes increasing a driving frequency of each of the pixel units 110 to 1 to 3 times to compensate for a display speed that is lowered due to gray scale value decomposition. The original one gray scale value is decomposed into two gray scale values which are displayed in two consecutive time periods, so that the display time of the picture is doubled, that is, the display speed is reduced by half. In order to compensate for the display speed that is lowered due to the gray scale value decomposition, the driving frequency can be increased.

In one of the embodiments, the driving frequency of each of the pixel units 110 is increased to 2 times to maintain the display speed of the pixel unit 110 after the gray scale value decomposition to be the same as the display speed before the gray scale value decomposition. Such setting is used for enabling the smoothness of the picture displayed after the gray scale value decomposition to be substantially the same as the smoothness of the picture displayed by the original gray scale data, thereby improving the color shift problem of the liquid crystal display without impairing the original visual effect.

In one of the embodiments, the backlight module 300 includes a backlight unit 320 configured to provide red, green and blue backlight sources. The driving method further includes increasing brightness of a color lamp controlled to be in an "on" state in the backlight unit 320 to 1 to 3 times to compensate for display brightness that is lowered due to the gray scale value decomposition, or increase of the driving frequency or the combined action of the gray scale value decomposition and the increase of the driving frequency. Since the process of gray scale value decomposition is to decompose an original high gray scale value into two new low gray scale values, that is, in practice, a group of high voltage signals is decomposed into two groups of low voltage signals, so the brightness is lowered. On the other hand, since the original one gray scale value is decomposed into two gray scale values which are displayed in two consecutive time periods, the display time of the picture is doubled, that is, the display speed is reduced by half. In order to compensate for the display speed that is lowered due to the gray scale value decomposition, the driving frequency is generally increased. After the driving frequency is increased, the brightness is lowered because the actual display time of each gray scale data group is shorter than that of an original driving frequency. For example, if the original driving frequency is increased to twice the original driving frequency, the actual display time of the driving signal becomes ½ of the original driving signal time, causing the reduction of the brightness. In order to compensate for the brightness that is lowered due to the gray scale value decomposition, or the increase of the driving frequency or the combined action of the gray scale value decomposition and the increase of the driving frequency, the backlight brightness can be increased.

In one of the embodiments, the brightness of the color lamp controlled to be in an "on" state in the backlight unit 320 is increased to 2 times to maintain the brightness of the pixel unit 110 after the gray scale value decomposition to be the same as the brightness before the gray scale value decomposition. Such setting is used for enabling the display effect after the gray scale value decomposition to be substantially the same as the display effect of the original gray scale data, thereby improving the color shift problem of the liquid crystal display without impairing the original visual effect.

In some embodiments, the pixel unit 110 includes a plurality of sub-pixels of different colors, and for example, may include a yellow sub-pixel and the like.

According to the above-mentioned driving method for a liquid crystal display device, the display module is divided into a plurality of mutually independent display areas 101, and a backlight panel is provided with at least one backlight unit 320 corresponding to each of the display areas 101. The original gray scale data group is decomposed into a first gray scale data group and a second gray scale data group according to a set grouping rule based on the type of the color corresponding to the original gray scale data group to be displayed by each of the pixel units 110, and the first gray scale data group and the second gray scale data group are respectively displayed in two consecutive time periods. Average gray scale value of the red sub-pixel, the green sub-pixel and the blue sub-pixel in gray scale values corresponding to the original gray scale data to be displayed in each of the display areas are respectively calculated, and the magnitudes of the average gray scale values corresponding to the red sub-pixel, the green sub-pixel and the blue sub-pixel in each of the display areas are respectively determined. When a decomposed gray scale data group is controlled to be displayed according to the magnitude relationship of the average gray scale values of the display areas, most backlights of the corresponding colors having the gray scale value of 0 are turned off.

Through such setting, the brightness ratio of the dominant hue is increased, so that the color shift due to the fact that the large viewing angle dominant hue is affected by a low voltage sub-pixel is improved. Meanwhile, the main signal brightness presentation under a large viewing angle is increased. The brightness of the overall image display can be maintained unchanged by increasing the backlight brightness to twice the original brightness, and the speed of the overall image display can be maintained unchanged by increasing the driving frequency to twice the original driving frequency. In addition, this application can achieve energy saving while improving color shift, and does not require additional wiring on the liquid crystal display panel.

This application further provides a driving method for a specific display area of a liquid crystal display device, where the liquid crystal display device 10 includes: a display module 100, the display module including a plurality of pixel units 110 arranged in an array; the pixel unit 110 including a red sub-pixel 111, a green sub-pixel 112 and a blue sub-pixel 113; and the display module 100 being divided into at least two mutually independent display areas; and a backlight module 300, provided with a plurality of backlight units 320; the backlight unit including a red light source, a green light source and a blue light source; and the display area corresponding to at least one of the backlight units 320. The driving method includes:

Calculating average gray scale values of the red sub-pixel, the green sub-pixel and the blue sub-pixel in gray scale values corresponding to the original gray scale data to be displayed in an $N^{th}$ display area.

Determining the magnitude of the average gray scale values corresponding to the red sub-pixel, the green sub-pixel and the blue sub-pixel in the $N^{th}$ display area. For the method or step of determining the magnitude of the average gray scale values corresponding to the red sub-pixel, the green sub-pixel and the blue sub-pixel in the $N^{th}$ display area, please refer to steps S210-S260 mentioned above.

In the time period of displaying the second gray scale data group, turning off a light source in the backlight unit 320 corresponding to the $N^{th}$ display area, provided that the light source has a same color as a sub-pixel having the minimum average gray scale value in the display area.

n and N are respectively an integer greater than or equal to 1.

In one of the embodiments, the method further includes: determining the type of the color corresponding to the original gray scale data group to be displayed by the $n^{th}$ pixel unit 110. The determining method or step is the same as steps S110-S170 mentioned above.

Dividing the original gray scale data group into a first gray scale data group and a second gray scale data group according to a set grouping rule based on the type of the color corresponding to the original gray scale data group to be displayed by the $n^{th}$ pixel unit 110. The grouping rule is the same as the "grouping rule" above.

Respectively outputting and displaying the first gray scale data group and the second gray scale data group in two consecutive time periods.

The first gray scale data group is a ternary mixed color gray scale data group, a binary mixed color gray scale data group or a unitary color gray scale data group.

The second gray scale data group is a binary mixed color gray scale data group or a unitary color gray scale data group.

The above liquid crystal display device 10 may include:

a display module 100, configured to display graphics and text information; the display module including a plurality of pixel units 110 arranged in an array; the pixel unit 110 including a red sub-pixel 111, a green sub-pixel 112 and a blue sub-pixel 113; the display module 100 being divided into at least two mutually independent display areas 101; a drive module 200, configured to receive, process and output driving data to control the display module to work normally; the drive module 200 including a gray scale data decomposition processing unit 210; the gray scale data decomposition processing unit 210 being configured to decompose the original gray scale data group to be displayed into a first gray scale data group and a second gray scale data group, and respectively output the gray scale values corresponding to the first gray scale data group and the second gray scale data group in two consecutive time periods; and a backlight module 300, provided with a plurality of backlight units 320; the backlight unit including a red light source, a green light source and a blue light source; the display area 101 corresponding to at least one of the backlight units 320; and the backlight units 320 corresponding to different display areas 101 being independent of each other.

According to the driving method for a liquid crystal display device described above, the above driving method can be used by the liquid crystal display device for a set area, or for a partial area according to the nature of the display data. Through such setting, the brightness ratio of the dominant hue of the liquid crystal display area using the above driving method can be increased, so that the color shift due to the fact that the large viewing angle dominant hue is affected by the low voltage sub-pixel is improved. In addition, the main signal brightness presentation under a large viewing angle condition in the liquid crystal display area using the above driving method can be increased, furthermore, the brightness of the overall image display can be maintained unchanged by increasing the backlight brightness to 2 times the original brightness, and the speed of the overall image display can be maintained unchanged by increasing the driving frequency to 2 times the original driving frequency. Meanwhile, this application does not require additional wiring on the liquid crystal display panel.

This application further provides a driving method for a liquid crystal display device, as shown in FIG. 1, the liquid crystal display device includes a display module 100 and a backlight module 300. The display module 100 includes a plurality of pixel units 110 arranged in an array, and the pixel unit 110 includes a red sub-pixel 111, a green sub-pixel 112 and a blue sub-pixel 113. The pixel unit 110 generates a color for each received gray scale value group. The gray scale value group is generated by gray scale data input to the display device. The gray scale value group includes a red gray scale value, a green gray scale value and a blue gray scale value. The color generated by the pixel unit 110 each time is any one of a unitary color type, a binary mixed color type and a ternary mixed color type.

The backlight module 300 includes a power processing unit 310 and a backlight unit 320. The drive module 200 includes a gray scale data decomposition processing unit 210, a driving frequency adjusting unit 220 and a backlight adjusting unit 230. The display module 100 is configured to display graphics and text information. The drive module 200 is configured to receive, process and output driving data to control the display module 100 to work normally. The backlight module 300 is configured to process a current and light the backlight unit 320. The backlight unit 320 includes a red light source 321, a green light source 322 and a blue light source 323. The display module 100 is divided into at least two mutually independent display areas 101. The display area 101 corresponds to at least one of the backlight units 320, and the backlight units 320 corresponding to different display areas 101 are independent of each other.

The gray scale data decomposition processing unit 210 is configured to decompose the input original gray scale data corresponding to each of the pixel units 110 into three groups of new gray scale data and output gray scale values of the red sub-pixel 111, the green sub-pixel 112 and the blue sub-pixel 113 in each of the pixel units 110 in three consecutive time periods. The driving frequency adjusting unit 220 is configured to adjust the driving frequency. The backlight adjusting unit 230 is configured to adjust the color and brightness of the backlight unit 320. The driving method includes:

Calculating an average gray scale value of the red sub-pixels 111, an average gray scale value of the green sub-pixels 112 and an average gray scale value of the blue sub-pixels 113 in gray scale values corresponding to the original gray scale data to be displayed in an $N^{th}$ display area 101.

Determining the magnitude of the average gray scale value of the red sub-pixels 111, the average gray scale value of the green sub-pixels 112 and the average gray scale value of the blue sub-pixels 113 in the $N^{th}$ display area 101.

In the time period of displaying the second gray scale data group, turning off a light source in the backlight unit 320 corresponding to the $N^{th}$ display area 101, the light source having a same color as a sub-pixel having the minimum average gray scale value in the $N^{th}$ display area 101.

In the time period of displaying the third gray scale data group, turning off a light source in the backlight unit 320 corresponding to the $N^{th}$ display area 101, which light source has a color different from that of the sub-pixel having the maximum average gray scale value in the $N^{th}$ display area 101.

N is an integer greater than or equal to 1.

In one of the embodiments, the method further includes: determining the type of the color corresponding to the original gray scale data according to the quantity of 0 gray scale data in the original gray scale data group to be displayed by the $n^{th}$ pixel unit 110.

When the original gray scale data group does not include the 0 gray scale data, it is determined that the color corresponding to the original gray scale data group is a ternary mixed color.

When the original gray scale data group includes only one piece of 0 gray scale data, it is determined that the color corresponding to the original gray scale data group is a binary mixed color.

When the original gray scale data group includes only two pieces of 0 gray scale data, it is determined that the color corresponding to the original gray scale data group is a unitary color.

n is an integer greater than or equal to 1.

In one of the embodiments, the method further includes: dividing the original gray scale data group into a first gray scale data group, a second gray scale data group and a third gray scale data group according to a set grouping rule based on the type of the color corresponding to the original gray scale data group to be displayed by the $n^{th}$ pixel unit 110.

Respectively outputting and displaying the first gray scale data group, the second gray scale data group and the third gray scale data group in three consecutive time periods.

n is an integer greater than or equal to 1.

In one of the embodiments, the first gray scale data group is a ternary mixed color gray scale data group, a binary mixed color gray scale data group or a unitary color gray scale data group.

The second gray scale data group is a binary mixed color gray scale data group or a unitary color gray scale data group.

The third gray scale data group is a unitary color gray scale data group.

According to the driving method for a liquid crystal display device, the display module 100 is divided into a plurality of mutually independent display areas 101, and the backlight panel is provided with at least one backlight unit 320 corresponding to each display area 101. The original gray scale data group is decomposed into a first gray scale data group, a second gray scale data group and a third gray scale data group according to a set grouping rule based on the type of the color corresponding to the original gray scale data group to be displayed by the $n^{th}$ pixel unit 110, and the three gray scale data groups are respectively displayed in three consecutive time periods. The average gray scale value of the red sub-pixels 111, the average gray scale value of the green sub-pixels 112 and the average gray scale value of the blue sub-pixels 113 in gray scale values corresponding to the original gray scale data to be displayed in the $N^{th}$ display area 101 are respectively calculated, and the magnitudes of the average gray scale value of the red sub-pixels 111, the average gray scale value of the green sub-pixels 112 and the average gray scale value of the blue sub-pixels 113 in the $N^{th}$ display area 101 are respectively determined. When the decomposed gray scale data group is controlled to be displayed according to the magnitude relationship of the average gray scale values of the display areas, most backlight units 320 of the corresponding colors having the gray scale value of 0 are turned off. Through such setting, the brightness ratio of the dominant hue in the specific display area is increased, so that the color shift due to the fact that the large viewing angle dominant hue is affected by the low voltage sub-pixel is improved. The main signal brightness presentation in the specific display area under a large viewing angle is increased. Meanwhile, the brightness of the overall image display can be maintained unchanged by increasing the backlight brightness in the display area to twice the original brightness, and the speed of the overall image display can be maintained unchanged by increasing the driving frequency in the specific display area to twice the original driving frequency. In addition, this application can achieve energy saving while improving color shift in the specific display area, and does not require additional wiring on the liquid crystal display panel.

This application further provides a driving method for a liquid crystal display device, where the liquid crystal display device 10 includes a display module 100 and a backlight module 300. The display module 100 includes a plurality of pixel units 110 arranged in an array, and the pixel unit 110 includes a red sub-pixel 111, a green sub-pixel 112 and a blue sub-pixel 113. The color generated by the pixel unit 110 each time is any one of a unitary color type, a binary mixed color type and a ternary mixed color type. The backlight module 300 is provided with a plurality of backlight units 320. The backlight unit 320 includes a red light source 321, a green light source 322 and a blue light source 323. The display module 100 is divided into at least two mutually independent display areas 101. The display area 101 corresponds to at least one of the backlight units 320, and the backlight units 320 corresponding to different display areas 101 are independent of each other. The driving method includes:

Calculating an average gray scale value of the red sub-pixels 111, an average gray scale value of the green sub-pixels 112 and an average gray scale value of the blue sub-pixels 113 in gray scale values corresponding to the original gray scale data to be displayed in each of the display areas 101.

Determining the magnitudes of the average gray scale value of the red sub-pixels 111, the average gray scale value of the green sub-pixels 112 and the average gray scale value of the blue sub-pixels 113 in each of the display areas 101.

Determining whether the quantity of the pixel units 110 displaying unitary color in the display area 101 reaches a first set value, and if yes, turning off a light source in the backlight unit 320 corresponding to the display area 101, which light source has a color different from that of the sub-pixel having the maximum average gray scale value in the $N^{th}$ display area 101.

When the display areas 101 in the display module 100 are physically divided, each display area 101 is fixed and relatively independent. The pattern displayed by each display area 101 is different according to the overall needs, some display areas 101 display only one color, and some display two or more colors. Or basically, some display areas 101 only display unitary colors, or only display binary mixed colors or only display ternary mixed colors, and some display areas 101 may display combinations of any two or three of a unitary color, a binary mixed color or a ternary mixed color. In some display areas 101, although the pixel units 110 of a certain mixed color type are relatively fewer in a certain display stage, when they are concentrated in a certain range of pixel blocks, if the color lamp corresponding to the minimum average gray scale value in the backlight unit 320 corresponding to the display area 101 is turned off according to a general control method, or the gray scale value of the color corresponding to the minimum average gray scale value in the display area 101 is set to 0, the quality of the picture may be affected, and the integrity of the picture may be even affected under severe conditions.

Therefore, more detailed control of this situation is needed when making the overall control rule. When the quantity of the pixel units 110 displaying the unitary colors in the display area 101 reaches the first set value, the light source in the backlight unit 320 corresponding to the display area 101, wherein the light source has a color different from that of the sub-pixel having the maximum average gray scale value in the display area 101, is turned off. "When the quantity of the pixel units 110 displaying the unitary colors in the display area 101 reaches the first set value" means that, in a certain display area 101, the unitary color pixel units 110 occupy the vast majority, and at this time, the characteristics of the display area 101 are mainly dominated by the unitary colors. Through controlling the off or on of the light source in the backlight unit 320 corresponding to the display area 101, wherein the light source has a color different from that of the sub-pixel having the maximum average gray scale value in the display area 101, according to the unitary color control rule, the display picture of the display area 101 can be changed, or the effect on the display picture of the display area is negligible.

In one of the embodiments, the driving method further includes: determining whether there is a pixel block in which the quantity of the pixel units 110 displaying unitary color in the display area reaches a second set value, and if yes, maintaining a light source, having a color different from that of the sub-pixel having the maximum average gray scale value in the $N^{th}$ display area, in the backlight unit 320 corresponding to the display area to be on; otherwise, turning off the light source, having a color different from that of the sub-pixel having the maximum average gray scale value in the $N^{th}$ display area, in the backlight unit 320 corresponding to the display area.

In this embodiment, "determining whether there is a pixel block in which the quantity of the pixel units 110 displaying unitary color in the display area reaches a second set value" means that although a certain unitary color occupies a very small portion of the pixel units 110 in the overall display area, this unitary color is not dispersed in the whole display area, but is concentrated in a certain pixel block. When the quantity of the unitary color pixel units 110 reaches a certain set value, the picture displayed in this display area will be affected. That is, there may be a certain color of which the average value of the gray scale values is the minimum for the whole display area; however, for a certain pixel block in the display area, the average gray scale value of this color is not the minimum in the pixel block. When the effect of this color on the pixel block is not negligible, the color lamp corresponding to the minimum average gray scale value in the backlight unit 320 corresponding to the display area needs to be maintained to be on in the time period of displaying the gray scale data group, therefore the color lamp corresponding to the minimum average gray scale value in the backlight unit 320 corresponding to the display area cannot be turned off according to the conventional method. Otherwise, the picture quality will be affected, or the integrity of the picture will be affected.

For example, a certain display area is divided into a first pixel block, a second pixel block and a third pixel block, the first pixel block displays the red unitary color, the second pixel block displays the green unitary color, the third pixel block displays the blue unitary color, the area of the first pixel block is larger than that of the second pixel block, and the area of the second pixel area is larger than that of the third pixel block. At this time, for the whole display area, the average value of the gray scale values of the blue sub-pixels 113 is the minimum. However, at this time, for the third pixel block, the blue sub-pixel 113 is its dominant color. If the color lamp corresponding to the blue sub-pixel 113 having the minimum gray scale value average value in the display area is turned off at this time, the third pixel block cannot perform display, which may seriously affect the originally displayed picture.

In one of the embodiments, the driving method further includes:

Determining whether the quantity of the pixel units 110 displaying binary mixed color in the display area reaches a third set value, and if yes, turning off a light source in the backlight unit 320 corresponding to the display area, which light source has a same color as a sub-pixel having the minimum average gray scale value in the display area. When the quantity of the pixel units 110 displaying binary mixed color in the display area reaches the third set value, turning off the light source in the backlight unit 320 corresponding to the display area, which light source has the same color as the sub-pixel having the minimum average gray scale value in the display area.

"When the quantity of the pixel units 110 displaying the binary mixed color in the display area reaches the third set value" means that, in a certain display area, the binary mixed color pixel units 110 occupy the vast majority, and at this time, the characteristics of the display area are mainly dominated by the binary mixed color. Through controlling the off or on of the light source in the backlight unit 320 corresponding to the display area, which light source has the same color as the sub-pixel having the minimum average gray scale value in the display area, according to the binary mixed color control rule, the display picture of the display area can be changed, or the effect on the display picture of the display area is negligible, thereby achieving energy saving while ensuring that the original picture is less affected.

According to the driving method for a liquid crystal display device, the display module 100 is divided into a plurality of mutually independent display areas, and the backlight panel 300 is provided with at least one backlight unit 320 corresponding to each display area. The average gray scale value of the red sub-pixel 111, the green sub-pixel 112 and the blue sub-pixel 113 in gray scale values corresponding to the original gray scale data to be displayed in each of the display areas is respectively calculated, and the magnitudes of the average gray scale values corresponding to the red sub-pixel 111, the green sub-pixel 112 and the blue sub-pixel 113 in each of the display areas is respectively determined.

When the decomposed gray scale data group is controlled to be displayed according to the magnitude relationship of the average gray scale values of the display areas, most backlight units 320 of the corresponding color having the gray scale value of 0 are turned off. Through such setting, the brightness ratio of the dominant hue is increased, so that the color shift due to the fact that the large viewing angle dominant hue is affected by the low voltage sub-pixel is improved. The main signal brightness presentation under a large viewing angle is increased. Meanwhile, the brightness of the overall image display can be maintained unchanged by increasing the backlight brightness to twice the original brightness, and the speed of the overall image display can be maintained unchanged by increasing the driving frequency to twice the original driving frequency. In addition, energy saving can be achieved while the color shift can be improved. No additional wiring on the liquid crystal display panel is required.

Technical features of the foregoing embodiments may be randomly combined. For the brevity of description, not all possible combinations of the technical features in the foregoing embodiments are described. However, as long as combinations of these technical features do not contradict each other, it should be considered that the combinations all fall within the scope of this specification.

The foregoing embodiments only describe several implementations of this application, which are described specifically and in detail, and therefore cannot be construed as a limitation to the patent scope of the present invention. It should be noted that, a person of ordinary skill in the art may make various changes and improvements without departing from the ideas of this application, which shall all fall within the protection scope of this application. Therefore, the protection scope of the patent of this application shall be subject to the appended claims.

The invention claimed is:

1. A driving method for a liquid crystal display device, wherein the liquid crystal display device comprises: a display module, the display module comprising a plurality of pixel units arranged in an array; each pixel unit comprising a red sub-pixel, a green sub-pixel and a blue sub-pixel; and the display module being divided into at least two mutually independent display areas; and a backlight module, provided with a plurality of backlight units, each backlight unit comprising a red light source, a green light source and a blue light source; the display area corresponding to at least one of the backlight units; and backlight units corresponding to different display areas being independent of each other; the driving method comprising:

determining, based on a quantity of 0 gray scale data in an original gray scale data group to be displayed by each of the pixel units, a type of a color corresponding to the original gray scale data;

dividing, based on the type of a color corresponding to the original gray scale data group to be displayed by each of the pixel units, the original gray scale data group into a first gray scale data group and a second gray scale data group according to a set grouping rule;

outputting and displaying the first gray scale data group and the second gray scale data group respectively in two consecutive time periods;

respectively calculating average gray scale values of the red sub-pixels, the green sub-pixels and the blue sub-pixels in gray scale values corresponding to original gray scale data group to be displayed in each of the display areas;

determining the magnitudes of the average gray scale values corresponding to the at least one red sub-pixel, the at least one green sub-pixel and the at least one blue sub-pixel in each of the display areas; and turning off a light source in the backlight unit corresponding to each of the display areas, which light source has a same color as a sub-pixel having the minimum average gray scale value in the display area.

2. The driving method for a liquid crystal display device according to claim 1, wherein determining, based on quantity of 0 gray scale data in an original gray scale data group to be displayed by each of the pixel units, a type of a color corresponding to the original gray scale data comprises:

determining that the color corresponding to the original gray scale data group is a ternary mixed color when the original gray scale data group does not comprise the 0 gray scale data.

3. The driving method for a liquid crystal display device according to claim 2, wherein the determining, based on quantity of 0 gray scale data in an original gray scale data group to be displayed by each of the pixel units, a type of a color corresponding to the original gray scale data further comprises:

determining that the color corresponding to the original gray scale data group is a binary mixed color when the original gray scale data group comprises only one piece of 0 gray scale data.

4. The driving method for a liquid crystal display device according to claim 2, wherein the determining, based on quantity of 0 gray scale data in an original gray scale data group to be displayed by each of the pixel units, a type of a color corresponding to the original gray scale data further comprises:

determining that the color corresponding to the original gray scale data group is a unitary color when the original gray scale data group comprises only two pieces of 0 gray scale data.

5. The driving method for a liquid crystal display device according to claim 1, wherein the first gray scale data group is a ternary mixed color gray scale data group, a binary mixed color gray scale data group or a unitary color gray scale data group.

6. The driving method for a liquid crystal display device according to claim 1, wherein the second gray scale data group is a binary mixed color gray scale data group or a unitary color gray scale data group.

7. The driving method for a liquid crystal display device according to claim 1, wherein the driving method further comprises:

increasing a driving frequency of each of the pixel units to 1 to 3 times to compensate for a display speed that is lowered due to gray scale value decomposition.

8. The driving method for a liquid crystal display device according to claim 7, wherein the driving method further comprises:

increasing brightness of a color lamp in the backlight unit, controlled to be in an on state, to 1 to 3 times to compensate for display brightness that is lowered due to the gray scale value decomposition, or the increase of the driving frequency or the combined action of the gray scale value decomposition and the increase of the driving frequency.

9. A driving method for a liquid crystal display device, wherein the liquid crystal display device comprises: a display module, the display module comprising a plurality of pixel units arranged in an array; each pixel unit comprising a red sub-pixel, a green sub-pixel and a blue sub-pixel; and the display module being divided into at least two mutually independent display areas; and a backlight module, provided with a plurality of backlight units, each backlight unit comprising a red light source, a green light source and a blue light source; the display area corresponding to at least one of the backlight units; and backlight units corresponding to different display areas being independent of each other; and the driving method comprising:

determining a type of a color corresponding to an original gray scale data group to be displayed by an $n^{th}$ pixel unit;

dividing, based on the type of a color corresponding to the original gray scale data group to be displayed by the $n^{th}$ pixel unit, the original gray scale data group into a first gray scale data group and a second gray scale data group according to a set grouping rule;

outputting and displaying the first gray scale data group and the second gray scale data group respectively in two consecutive time periods;

calculating average gray scale values of the red sub pixels, the green sub pixels and the blue sub pixels in gray scale values corresponding to original gray scale data group to be displayed in an $N^{th}$ display area;

determining magnitudes of the average gray scale values corresponding to the at least one red sub-pixel, the at least one green sub-pixel and the at least one blue sub-pixel in the $N^{th}$ display area; and turning off a light source in a backlight unit corresponding to the $N^{th}$ display area, which light source has a same color as a sub-pixel having a minimum average gray scale value in the display area, wherein N and n are each an integer greater than or equal to 1.

10. The driving method for a liquid crystal display device according to claim 9, wherein the first gray scale data group is a ternary mixed color gray scale data group, a binary mixed color gray scale data group or a unitary color gray scale data group.

11. The driving method for a liquid crystal display device according to claim 9, wherein the second gray scale data group is a binary mixed color gray scale data group or a unitary color gray scale data group.

12. The driving method for a liquid crystal display device according to claim 9, wherein the method further comprises:

determining a type of a color corresponding to an original gray scale data group to be displayed by an $n^{th}$ pixel unit;

dividing, based on the type of the color corresponding to the original gray scale data group to be displayed by the $n^{th}$ pixel unit, the original gray scale data group into a first gray scale data group, a second gray scale data group and a third gray scale data group according to a set grouping rule; and outputting and displaying the first gray scale data group, the second gray scale data group and the third gray scale data group respectively in three consecutive time periods, wherein n is an integer greater than or equal to 1.

13. The driving method for a liquid crystal display device according to claim 12, wherein the first gray scale data group is a ternary mixed color gray scale data group, a binary mixed color gray scale data group or a unitary color gray scale data group.

14. The driving method for a liquid crystal display device according to claim 12, wherein the second gray scale data group is a binary mixed color gray scale data group or a unitary color gray scale data group.

15. The driving method for a liquid crystal display device according to claim 12, wherein the third gray scale data group is a unitary color gray scale data group.

16. A driving method for a liquid crystal display device, wherein the liquid crystal display device comprises: a display module, the display module comprising a plurality of pixel units arranged in an array; each pixel unit comprising a red sub-pixel, a green sub-pixel and a blue sub-pixel; and the display module being divided into at least two mutually independent display areas; and a backlight module, provided with a plurality of backlight units, each backlight unit comprising a red light source, a green light source and a blue light source; the display area corresponding to at least one of the backlight units; and backlight units corresponding to different display areas being independent of each other; the driving method comprising:

determining, based on a quantity of 0 gray scale data in an original gray scale data group to be displayed by each of the pixel units, a type of a color corresponding to the original gray scale data;

dividing, based on the type of a color corresponding to the original gray scale data group to be displayed by each of the pixel units, the original gray scale data group into a first gray scale data group and a second gray scale data group according to a set grouping rule;

outputting and displaying the first gray scale data group and the second gray scale data group respectively in two consecutive time periods;

respectively calculating average gray scale values of the red sub pixels, the green sub pixels and the blue sub pixels in gray scale values corresponding to original gray scale data group to be displayed in each of the display areas;

determining magnitudes of the average gray scale values corresponding to the at least one red sub-pixel, the at least one green sub-pixel and the at least one blue sub-pixel in each of the display areas; and determining whether a quantity of pixel units displaying a unitary color in each of the display areas reaches a preset first set value, and if yes, turning off a light source in the backlight unit corresponding to the display area, which light source has a same color as a sub-pixel having a minimum average gray scale value in the display area.

17. The driving method for a liquid crystal display device according to claim 16, wherein the determining, based on a quantity of 0 gray scale data in an original gray scale data group to be displayed by each of the pixel units, a type of a color corresponding to the original gray scale data comprises:

determining that the color corresponding to the original gray scale data group is a ternary mixed color when the original gray scale data group does not comprise the 0 gray scale data; determining that the color corresponding to the original gray scale data group is a binary mixed color when the original gray scale data group comprises only one piece of 0 gray scale data; or determining that the color corresponding to the original gray scale data group is a unitary color when the original gray scale data group comprises only two pieces of 0 gray scale data.

* * * * *